US009062408B2

(12) United States Patent
Kim et al.

(10) Patent No.: US 9,062,408 B2
(45) Date of Patent: Jun. 23, 2015

(54) METHOD OF CONTROLLING WASHING MACHINE

(75) Inventors: Youngjong Kim, Changwon-si (KR); Hyuksoo Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1242 days.

(21) Appl. No.: 12/847,574

(22) Filed: Jul. 30, 2010

(65) Prior Publication Data

US 2011/0047715 A1 Mar. 3, 2011

Related U.S. Application Data

(60) Provisional application No. 61/230,517, filed on Jul. 31, 2009.

(30) Foreign Application Priority Data

Jul. 31, 2009 (KR) ..... 10-2009-0071037
Dec. 9, 2009 (KR) ..... 10-2009-0121916

(51) Int. Cl.
*D06F 37/20* (2006.01)
*D06F 37/22* (2006.01)

(52) U.S. Cl.
CPC ..... *D06F 37/225* (2013.01); *D06F 37/203* (2013.01)

(58) Field of Classification Search
CPC ..... D06F 37/225
See application file for complete search history.

(56) References Cited

U.S. PATENT DOCUMENTS 4,054,412 A * 10/1977 Brummett et al. ..... 8/158
6,647,575 B2 * 11/2003 Garstecki et al. ..... 8/159
2002/0016997 A1 * 2/2002 Jonsson ..... 8/159
2008/0301884 A1 * 12/2008 Lee et al. ..... 8/159

* cited by examiner

*Primary Examiner* — Jason Ko
(74) *Attorney, Agent, or Firm* — Birch, Stewart, Kolasch & Birch, LLP

(57) ABSTRACT

A method of controlling a washing machine is provided. The rotation and rotation driving time of a inner tub having an auto balancer are controlled based on preset values considering sections during which a horizontal unbalancing phenomenon and a vertical unbalancing phenomenon occur. Accordingly, abnormal vibrations and resultant damage or deformation of the washing machine may be prevented. Further, electricity may be saved.

7 Claims, 12 Drawing Sheets

SECOND CONTROL SECTION

FOURTH CONTROL SECTION

FOURTH CONTROL SECTION

FIG. 6

| CONTROL SECTION | RPM | CONTROL METHOD FOR STARTING TIME (mms) | note |
|---|---|---|---|
| FIRST CONTROL SECTION | 20 | 500 | |
| FIRST CONTROL SECTION | 21 | 20000 | |
| SECOND CONTROL SECTION | 65 | 60 | MAXIMUM HORIZONTAL UNBALANCING |
| THIRD CONTROL SECTION | 130 | 1200 | |
| FOURTH CONTROL SECTION | 170 | 300 | MAXIMUM VERTICAL UNBALANCING |
| FIFTH CONTROL SECTION | 220 | 1200 | |
| FIFTH CONTROL SECTION | 240 | 100 | |
| FIFTH CONTROL SECTION | 270 | 1200 | |
| FIFTH CONTROL SECTION | 280 | 100 | |
| FIFTH CONTROL SECTION | 330 | 100 | |
| FIFTH CONTROL SECTION | 400 | 1200 | |

FIG. 7

| CONTROL SECTION | RPM | CONTROL METHOD FOR STARTING TIME (mms) | note |
|---|---|---|---|
| FIRST CONTROL SECTION | 20 | 500 | |
| FIRST CONTROL SECTION | 40 | 20000 | RAPIDLY INCREASE RPM FOR PREVENTING HORIZONTAL UNBALANCING |
| THIRD CONTROL SECTION | 100 | 60 | |
| THIRD CONTROL SECTION | 120 | 1200 | |
| THIRD CONTROL SECTION | 140 | 1200 | |
| THIRD CONTROL SECTION | 160 | 1200 | INCREMENTALLY INCREASE RPM FOR PREVENTING VERTICAL UNBALANCING |
| THIRD CONTROL SECTION | 180 | 1200 | |
| FOURTH CONTROL SECTION | 200 | 1200 | |
| FIFTH CONTROL SECTION | 240 | 2400 | |
| FIFTH CONTROL SECTION | 330 | 2400 | |
| FIFTH CONTROL SECTION | 400 | 2400 | |

METHOD OF CONTROLLING WASHING MACHINE

CROSS-REFERENCE TO RELATED APPLICATION

This application claims the priority benefit of Korean Patent Application No. 10-2009-0071037, filed on Jul. 31, 2009, Korean Patent Application No. 10-2009-0121916, filed on Dec. 9, 2009 in the Korean Intellectual Property Office, and U.S. Provisional Patent Application No. 61/230,517 filed on Jul. 31, 2009 in the USPTO, the disclosure of which is incorporated herein by reference.

BACKGROUND OF THE INVENTION

1. Technical Field

The disclosure is directed to a method of controlling a washing machine, and more specifically, to a method of controlling a washing machine that controls the rotation and rotation driving time of a inner tub so that an auto balancer may properly balance the inner tub while the inner tub rotates.

2. Discussion of the Related Art

In general, a washing machine removes dirt or contaminants from laundry, such as clothing or bedding, by a chemical reaction of water and detergent and a physical action, such as rubbing between water and laundry. The washing machine may further include a dryer that dehydrates and dries the wet laundry and a refresher that sprays steam to the laundry to prevent allergy and helps to wash the laundry.

Washing machines may be classified into an agitator type, a drum type, and a pulsator type according to their structure and washing method. Generally, a washing machine performs a washing cycle, a rinsing cycle, and a dehydrating cycle some of which may be only carried out by user's selection. The washing machine cleans the laundry by a proper washing process depending on the type of laundry.

A washing machine includes a inner tub that receives laundry and rotates to perform washing, rinsing, and dehydrating cycles. And, the washing machine may further include an auto balancer that reduces vibrations that might occur due to a bias of the laundry while the inner tub rotates.

The auto balancer is generally included in the inner tub and includes a path through which a liquid passes. The auto balancer allows the liquid to travel in the opposite direction from the biased laundry along the path to correct the bias of the laundry occurring while the inner tub rotates at high speed, so that the inner tub may normally rotate.

In the conventional washing machine, however, the liquid in the auto balancer fails to travel in the opposite direction from the biased laundry when the inner tub rotates at a certain speed, thus causing a lowering in capability of compensating for the bias.

SUMMARY OF THE INVENTION

Exemplary embodiments provide a method of controlling a washing machine that may prevent a horizontal unbalancing phenomenon occurring when the inner tub vibrates in a horizontal direction during rotation and a vertical unbalancing phenomenon occurring when the inner tub vibrates in a vertical direction during rotation so that the auto balancer may properly play a role.

According to an embodiment of the present invention, there is provided a method of controlling a washing machine having an auto balancer that compensates for an unbalancing phenomenon occurring when a inner tub rotates, wherein a RPM range correspondent with a rotation section of the inner tub during which the unbalancing phenomenon occurs is inputted to a controller as an individual setting value, and the controller controls the inner tub to avoid the unbalancing phenomenon when a RPM value of the inner tub reaches the inputted setting value.

According to an embodiment of the present invention, there is provided a method of controlling a washing machine having an auto balancer compensating for an unbalancing phenomenon occurring when a inner tub rotates and a vibration sensing means sensing an abnormal vibration of the inner tub, the method comprising: sensing by the vibration sensing means a horizontal unbalancing rotation section during which the inner tub is biased in left and right directions with respect to a vertical axis while the inner tub rotates and a vertical unbalancing rotation section during which the inner tub is biased in upper and lower directions with respect to the vertical axis while the inner tub rotates; and after sensing the horizontal and vertical unbalancing rotation sections, controlling the inner tub by a controller to avoid the horizontal unbalancing rotation section and the vertical unbalancing rotation section.

In the method of controlling the washing machine configured as above, the rotation off the inner tub is controlled based on preset control values, so that abnormal vibrations of the inner tub and vibration noise may be prevented. Further, since the abnormal vibrations may be prevented, there is no need for macerating the laundry, and thus electricity may be saved.

BRIEF DESCRIPTION OF THE DRAWINGS

FIG. 6 is a table illustrating sections during which a horizontal unbalancing phenomenon and a vertical unbalancing phenomenon occur in a conventional washing machine.

FIG. 7 is a table illustrating a method of controlling a washing machine according to an embodiment of the present invention.

DETAILED DESCRIPTION OF THE EXEMPLARY EMBODIMENTS

Hereinafter, an embodiment of the present invention will be described with reference to the accompanying drawings.

Figure 1:
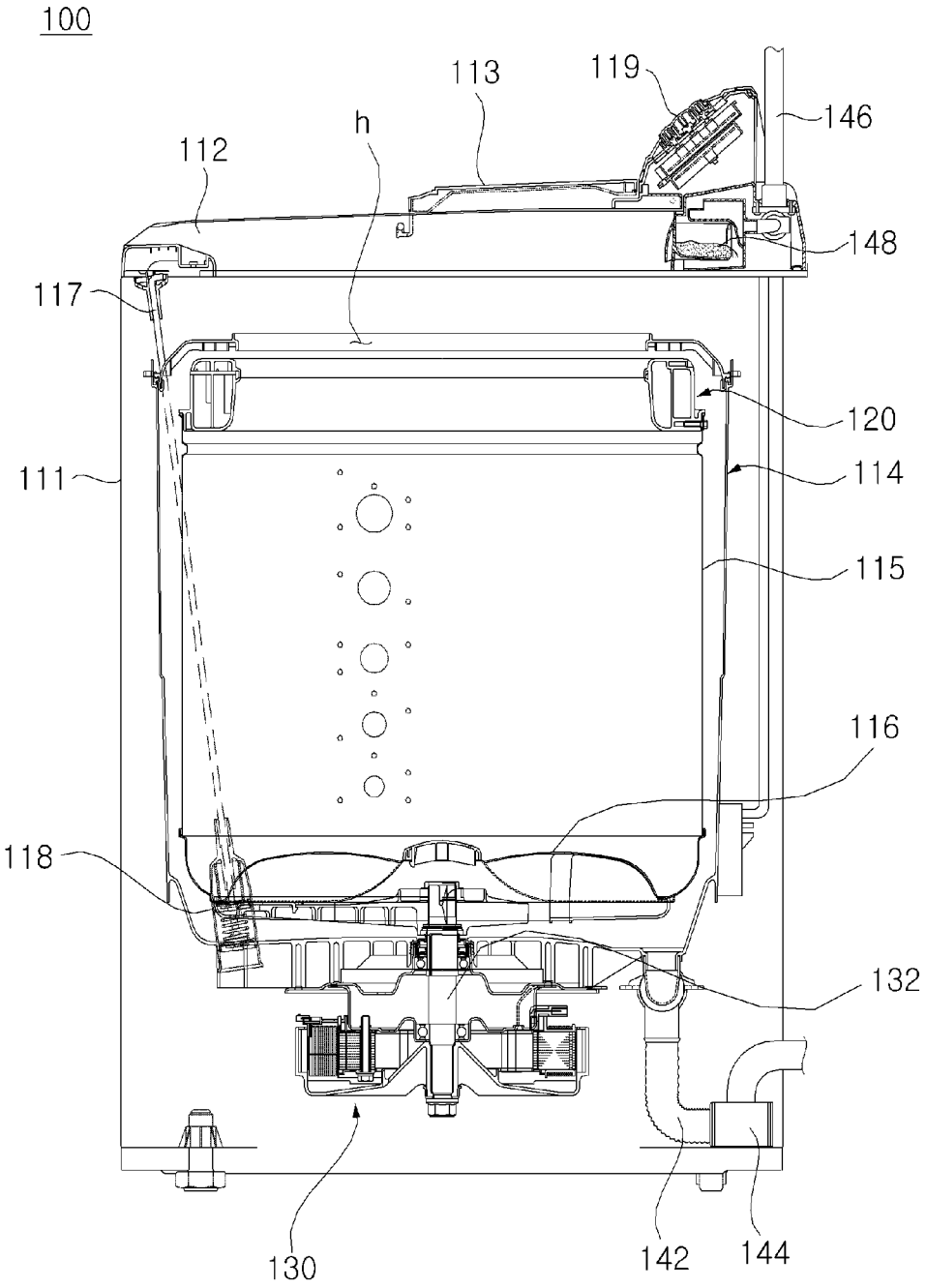
FIG. 1 is a side cross sectional view illustrating a washing machine according to an embodiment of the present invention.
Figure 2:
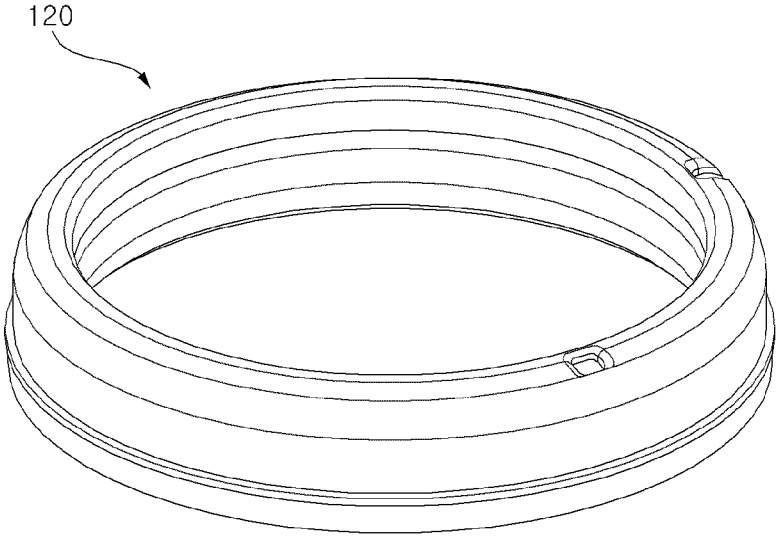
FIG. 2 is a perspective view illustrating an auto balancer included in the washing machine shown in FIG. 1.
Figure 3:
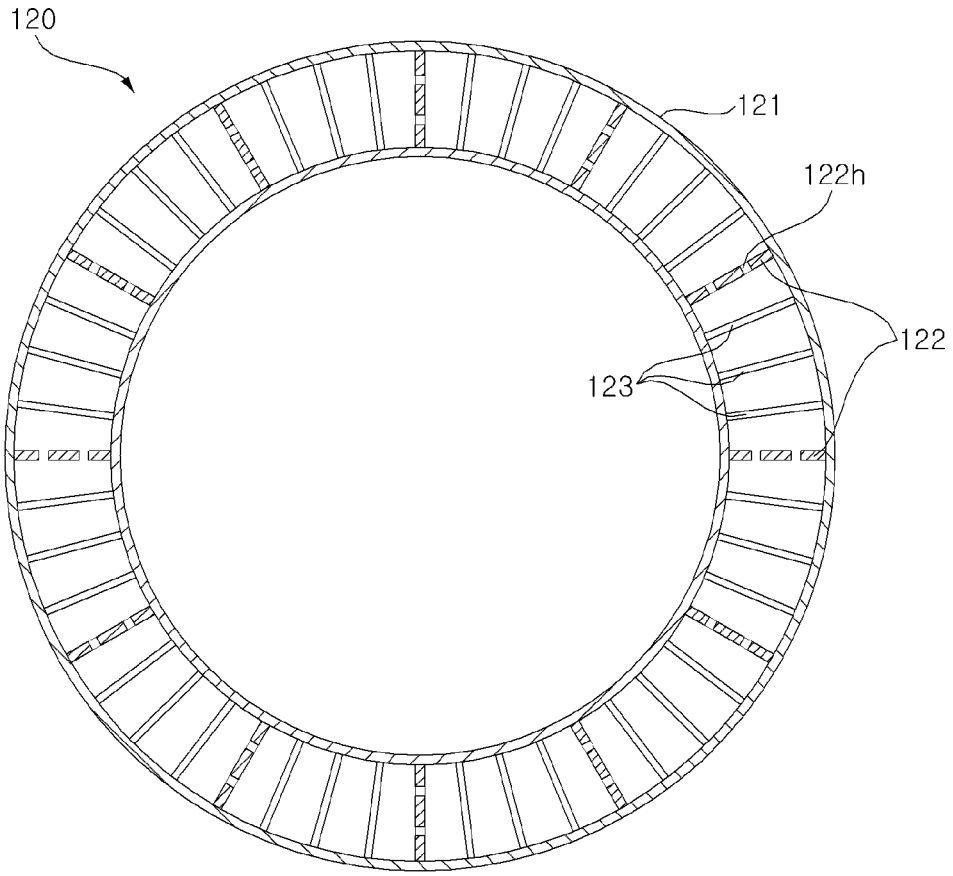
FIG. 3 is a plan cross sectional view illustrating an auto balancer included in the washing machine shown in FIG. 1.
Figure 4:
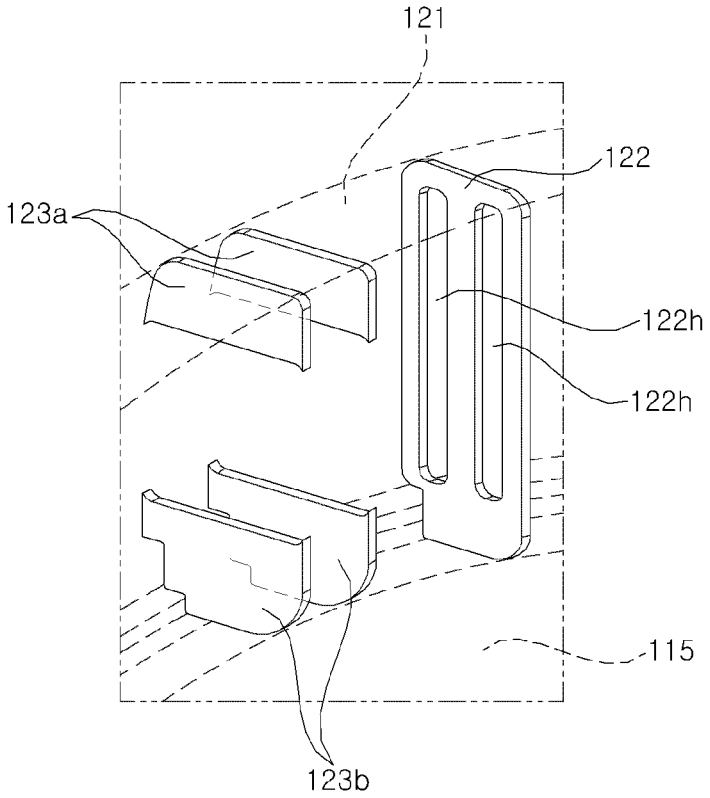
FIG. 4 is a perspective view illustrating an inner structure of the auto balancer shown in FIGS. 2 and 3.

FIG. 1 is a side cross sectional view illustrating a washing machine according to an embodiment of the present invention, FIG. 2 is a perspective view illustrating an auto balancer included in the washing machine shown in FIG. 1, FIG. 3 is a plan cross sectional view illustrating an auto balancer included in the washing machine shown in FIG. 1, FIG. 4 is a perspective view illustrating an inner structure of the auto balancer shown in FIGS. 2 and 3, FIGS. 5A to 5F are views illustrating operational processes of an auto balancer when the RPM of the inner tub is controlled, FIG. 6 is a table illustrating sections during which a horizontal unbalancing phenomenon and a vertical unbalancing phenomenon occur in a conventional washing machine, and FIG. 7 is a table illustrating a method of controlling a washing machine according to an embodiment of the present invention.

As shown in FIG. 1, the washing machine 100 includes a cabinet 111, a top cover 112, a door 113, a control panel 119, a outer tub 114, a inner tub 115, a water supply path 146, a pulsator 116, a driving unit 130, a drainage pump 144, and a drainage path 142.

The cabinet 111 forms the appearance of the washing machine 100. The top cover 112 is positioned at an upper side of the cabinet 111 and has an opening at its substantially central portion. The door 113 opens and closes the opening. The control panel 119 is arranged on the top cover 112 to receive various commands from a user. The outer tub 114 is arranged at the inside of the cabinet 111 and supported by a suspension and a damper. The outer tub 114 has at its top side an opening h through which laundry is entered and exited. The inner tub 115 is arranged at the inside of the outer tub 114. The inner tub 115 rotates to wash the laundry therein. The water supply path 146 supplies washing water into the outer tub 114 and the inner tub 115. The pulsator 116 is arranged at a lower side of the inner tub 115 to create a rotational water flow. The driving unit 130 rotates a shaft 132 so that the inner tub 115 and/or the pulsator 116 may rotate. The drainage pump 144 and the drainage path 142 discharge washing water from the outer tub 114.

When it comes to the operation of the washing machine 100, a user selects a preprogrammed washing mode, such as a standard mode, a saving mode, a wool mode, a hand wash mode, and a macerating mode, through the control panel 119, or arbitrarily selects an individual cycle, such as a washing cycle, a rinsing cycle, and a dehydrating cycle and enters various commands, such as setting a time for the selected cycle. By doing so, the washing machine 100 starts operation.

Thereafter, washing water is supplied from an external water source (not shown) through the water supply path 146 to the inner tub 115. The washing water also passes through a detergent box 148.

When the washing water reaches a certain level in the inner tub 115, the water supply is stopped and then the inner tub 115 is rotates so that a washing cycle, a rinsing cycle, and a dehydrating cycle are sequentially performed, or a cycle selected by a user is performed.

To compensate for vibrations due to biasing (eccentric movement) of the laundry contained in the rotating inner tub 115, an auto balancer 120 is provided in the inner tub 115. For example, the auto balancer 120 compensates for the non-uniform mass distribution.

Specifically, as shown in FIGS. 2 and 3, the auto balancer 120 includes a balancer ring 121 arranged along the circumferential direction of the inner tub 115 and filled with a liquid, such as salt water, a plurality of baffles 122 arranged inside of the balancer ring 121, each of which has at least one fluid hole **122*h* through which the liquid may pass, and at least anti-deformation rib 123 arranged between the baffles 122**.

The fluid hole **122*h* has a predetermined height from the bottom surface of the baffle 122. When the inner tub 115 fails to reach a predetermined rotation speed, the liquid filled in the balancer ring 121 is hindered from flowing by the baffle 122. However, when the inner tub 115 reaches the predetermined rotation speed, the level of the liquid is raised due to a centrifugal force so that the liquid may freely move through the fluid hole 122*h*. Accordingly, the liquid may travel in the direction opposite of the laundry biased in the inner tub 115**, and the bias may be thereby compensated.

In other words, when the inner tub 115 rotates with the laundry biased to a side of the inner tub 115, i.e., with a bias introduced due to non-uniform mass distribution, the auto balancer 120 allows the liquid filled in the balancer ring 121 to travel in the direction opposite of the biased laundry to compensate for the bias so that the inner tub 115 may be stably rotated.

The liquid in the balancer ring 121 may uniformly move in the direction opposite of the laundry biased to a side of the inner tub 115 for the inner tub 115 to stably rotate over the entire time. For example, the center of the liquid travelling in the balancer ring 121 may be in alignment with the rotational center of the inner tub 115 with respect to the center of the laundry biased to the side of the inner tub 115—that is, the center of the liquid may make an angle of 180 degrees with the rotational center of the inner tub 115.

For example, the auto balancer 120 may be most critically used for a dehydrating cycle. During the dehydrating cycle, the inner tub 115 rotates at high speed, thus creating significant vibrations. Accordingly, it may be important to control the rotation of the inner tub 115 during the dehydrating cycle to reduce the vibrations. However, the method of controlling the washing machine 100 according to this embodiment may apply to all of the cycles included in a washing process without being limited to application to the dehydrating cycle.

If the auto balancer 120 fails to exert its own functions, the inner tub 115 rotates with the central center biased and thus collides with the inside of the case, thus causing noises.

When the mass distribution of the laundry becomes non-uniform in the inner tub 115 and the inner tub 115 rotates under this situation, the liquid in the balancer ring 121 of the auto balancer 120 should be moved in an ideal manner as described above. However, applicant's experiments showed that the center of the biased laundry failed to be in alignment with the center of the liquid with respect to the rotational center of the inner tub 115 while controlling the rotation of the inner tub 115 over a predetermined RPM section, as shown in FIGS. 5A to 5F.

Figure 5A:
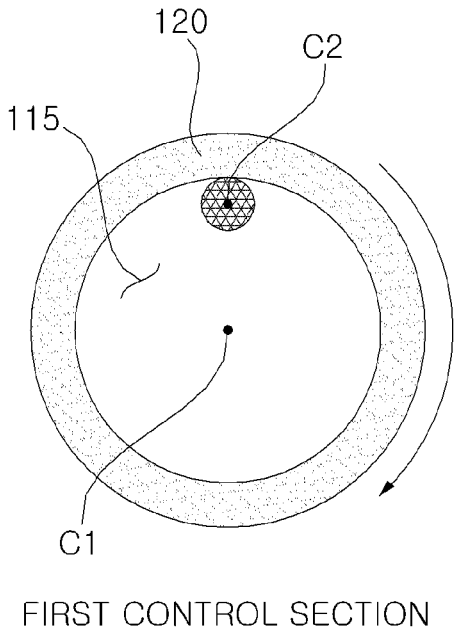
FIGS. 5A to 5F are views illustrating operational processes of an auto balancer when the RPM of the inner tub is controlled.
Figure 5B:
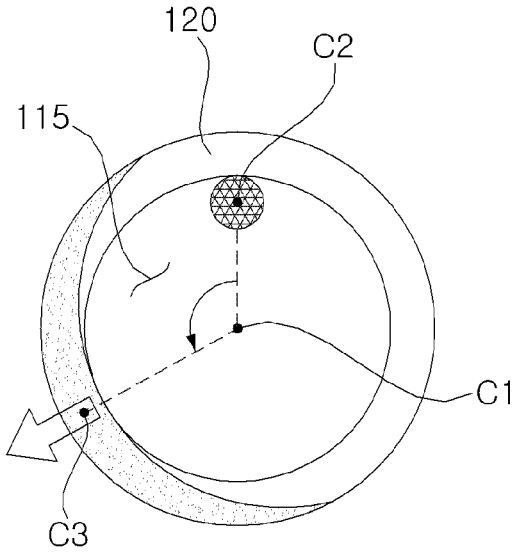
Figure 5C:
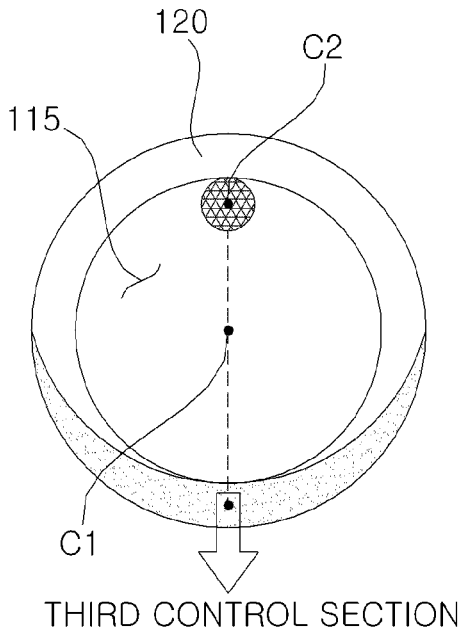
Figure 5D:
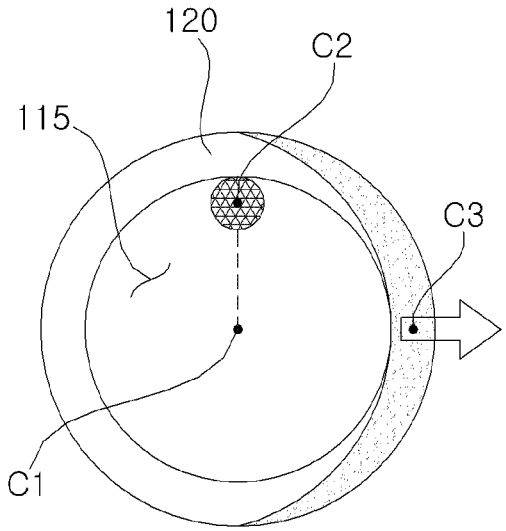
Figure 5E:
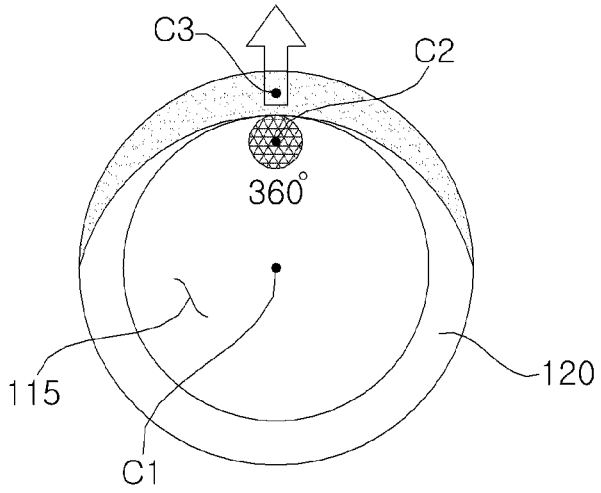
Figure 5F:
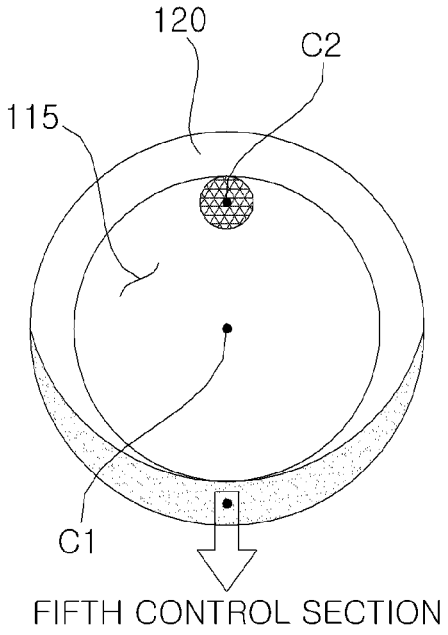

More specifically, referring to FIGS. 5A to 6, at the early stage of a dehydrating cycle, the inner tub 115 is accelerated while rotating at low speed until the inner tub 115 reaches a predetermined RPM control section irrespective of driving time. Accordingly, at this stage, a bias of the inner tub 115 (hereinafter, "unbalancing phenomenon") rarely occurs. For purposes of brevity, the above-mentioned predetermined PRM control section during which the inner tub 115 is accelerated for initial rotation is referred to as "first control section".

During another predetermined RPM control section (for purposes of brevity, "second control section") after the inner tub 115 has been accelerated to some degree, the inner tub 115 causes the unbalancing phenomenon that the inner tub 115 sways in left and right directions with respect to the central axis, causing horizontal vibrations. For purposes of brevity, the phenomenon that the inner tub 115 is horizontally vibrated is referred to as "horizontal unbalancing phenomenon". While rotating in the case, the inner tub 115 severely sways in the left and right directions to collide with the case, thus causing noises.

When the inner tub 115 rotates during a RPM control section having a higher rotation speed than a rotation speed of the second control section (for purposes of brevity, "third control section"), the auto balancer 120 performs its own functions and thus the above-mentioned horizontal unbalancing phenomenon disappears.

However, when the rotation of the inner tub 115 is controlled during another control section (for purposes of brevity, "fourth control section") having a higher rotation speed than a rotation speed of the third control section, an unbalancing phenomenon occurs that the inner tub 115 is vertically vibrated with respect to the central axis. Such a phenomenon will now be referred to as "vertical unbalancing phenomenon" for purposes of brevity.

When the inner tub 115 rotates at higher rotation speed than a rotation speed of the fourth control section to acquire the maximum speed in the dehydrating cycle during a predetermined control section (for purposes of brevity, "fifth control section"), the vertical unbalancing phenomenon of the inner tub 115 disappears and the auto balancer 120 works well, so that the inner tub 115 is stably rotated.

The horizontal unbalancing phenomenon and the vertical unbalancing phenomenon occurring during the second control section and the fourth control section are commonly caused in various types of washing machines including an auto balancer, such as the washing machine 100 including the auto balancer 120. Such unbalancing phenomena are considered as a transitional phenomenon that occurs until the auto balancer 120 properly functions as the liquid flows in the balancer ring 121 of the auto balancer 120.

In particular, as described above in connection with FIG. 5B, the horizontal unbalancing phenomenon occurs when the liquid cannot completely travel in the balancer ring 121 in the opposite direction from the center of the laundry with respect to the axis of the inner tub 115, and as described above in connection with FIGS. 5D and 5E, the vertical unbalancing phenomenon occurs when the liquid travels in the balancer ring 121 toward the center of the laundry with respect to the axis of the inner tub 115.

As a method of addressing the problem, the internal shape of the balancer ring 121 may be properly changed to reduce to some degree the section during which the unbalancing phenomena occur. However, such a method cannot be a fundamental solution. Despite the above method, for example, it is difficult to overcome problems with physical time that the liquid moves in the balancer ring 121.

Accordingly, an embodiment of the present invention suggests a method of controlling the washing machine 100 that may prevent the unbalancing phenomena by allowing a controller to make the number of rotations (hereinafter, "RPM") and the rotation control time of the inner tub 115 different between the second control section and the fourth control section during which the unbalancing phenomena occur previously considering a time that it would take the liquid to move in the balancer ring 121.

FIGS. 6 and 7 show exemplary RPMs and driving control times of the inner tub 115. However, the numerals are provided only as examples for convenience of description. The present invention is not limited to the numerals. For example, the RPM and the driving control time of the inner tub 115 may be determined depending on the type and size of the washing machine 100, and the amount of laundry.

A method of controlling the washing machine 100 according to an embodiment will now be described in greater detail.

Referring to FIGS. 6 and 7, the washing machine 100 is controlled to skip the second control section during which the horizontal unbalancing phenomenon maximally occurs with a RPM of 65 and a driving control time of 60 mms. That is, to prevent the horizontal unbalancing phenomenon from occurring during the second control section, the inner tub 115 is driven with a RPM of 40 for a sufficient time (for example, 20,000 mms) before the horizontal unbalancing phenomenon occurs, and then driven with a RPM of 100 for 60 mms that corresponds to the third control section, as shown in FIG. 7.

By doing so, the inner tub 115 directly goes from the first control section to the third control section and thus its rotation speed swiftly increases. As such, because the second control section is skipped, no horizontal unbalancing phenomenon occurs.

In other words, in the method of controlling the washing machine 100 according to an embodiment of the present invention, a control section during which the horizontal unbalancing phenomenon occurs, such as, for example, the second control section according to the above embodiment, is preset and the inner tub 115 is controlled to avoid the preset control section, thereby preventing the horizontal unbalancing phenomenon.

As shown in FIGS. 6 and 7, the washing machine 100 is controlled to minimize the fourth control section during which the vertical unbalancing phenomenon occurs with a RPM of 170 for 300 mms. To prevent the unbalancing phenomenon from occurring during the fourth control section, the rotation of the inner tub 115 is controlled so that its RPM is incrementally increased for each of a plurality of subsections divided between the third control section during which RPM is 120 and before the vertical unbalancing phenomenon occurs and the fifth control section during which RPM is 180 to 200—for example, the inner tub 115 is controlled to rotate for a sufficient time, such as 1,200 mms for each subsection, as shown in FIG. 7.

The reason why the RPM of the inner tub 115 is incrementally increased to prevent the vertical unbalancing phenomenon is to prevent the liquid in the balancer ring 121 from being rapidly moved toward the biased laundry with respect to the rotational axis of the inner tub 115 due to swift acceleration.

According to an embodiment, to make the fourth control section indistinguishable from the neighboring control sections, such as the third control section and the fifth control section, at least five subsections are preset between the third control section and the fifth control section. And, each subsection has a RPM increment of about 20 and a driving control time of 1,200 mms with which the rotation of the inner tub 115 may be gradually accelerated.

In other words, in the method of controlling the washing machine 100 according to an embodiment of the present invention, a control section during which the vertical unbalancing phenomenon occurs, such as, for example, the fourth control section according to the above embodiment, is preset and the inner tub 115 is controlled to incrementally (gradually) increase the RPM of the inner tub 115 so that the control section cannot be easily distinguishable from its neighboring control sections, thereby preventing the vertical unbalancing phenomenon.

A conventional method of controlling a washing machine includes an unbalancing checking step of determining whether the center of laundry put in a inner tub is biased during a washing cycle, a rinsing cycle, and a dehydrating cycle, and a macerating step of, if determined to be biased, rotating the inner tub at a certain RPM to untangle the laundry.

In a method of controlling the washing machine 100 according to an embodiment of the present invention, the inner tub 115 is controlled based on preset rotation control values so that the auto balancer properly performs its functions irrespective of no matter which washing stage it is. Accordingly, the above-described horizontal unbalancing phenomenon and vertical unbalancing phenomenon do not occur. This eliminates the need for the unbalancing checking step and the macerating step, and thus, electricity may be saved.

Figure 8:
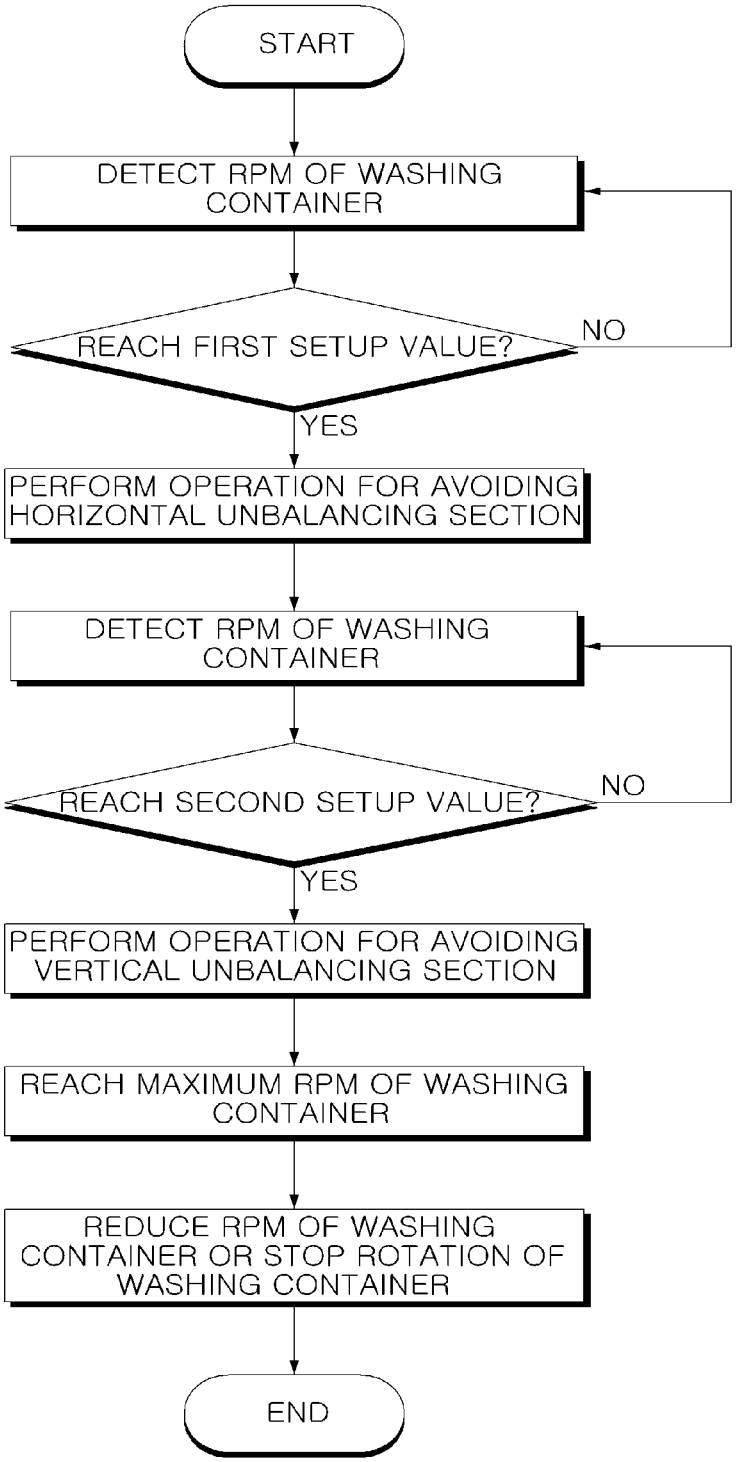
FIG. 8 is a flowchart illustrating a method of controlling a washing machine according to an embodiment of the present invention.

FIG. 8 is a flowchart illustrating a method of controlling a washing machine according to an embodiment of the present invention.

For example, FIG. 8 illustrates a method of controlling the washing machine 100 configured as above.

First, a control section during which a horizontal unbalancing phenomenon occurs and a control section during which a vertical unbalancing phenomenon occurs are set, for example, by manufacturer's experiment. The preset control sections may vary with the volume of the washing machine 100, the size or maximum rotation speed of the inner tub 115, and the amount of laundry.

Next, the operation button of the control panel 119 is pressed by a user to start washing. Then, the inner tub 115 rotates, and a controller performs avoidance driving control for avoiding a horizontal unbalancing phenomenon and a vertical unbalancing phenomenon based on preset values. More specifically, the washing machine 100 according to an embodiment includes a controller (not shown) that controls the overall operation, such as, for example, the rotation of the inner tub 115 of the washing machine 100.

As shown in FIG. 8, the controller senses the RPM of the inner tub 115. When the RPM of the inner tub 115 reaches a first setting value, which may be any value that may corresponds to a point in the first control section, the controller rapidly accelerates the rotation of the inner tub 115 to skip the second control section during which a horizontal unbalancing phenomenon occurs.

Thereafter, when the RPM of the inner tub 115 reaches a second setting value, which may be any value that may correspond to a point in the third control section, the controller performs control for avoiding occurrence of a vertical unbalancing phenomenon, that is, the controller incrementally accelerates the rotation of the inner tub 115 based on the RPM values and driving control times set for a plurality of subsections divided to be indistinguishable from the fourth control section.

When the rotation of the inner tub 115 reaches the maximum RPM in the fifth control section, the controller may reduce the RPM of the inner tub 115 or stop the rotation of the inner tub 115.

As such, in the method of controlling the washing machine 100 according to an embodiment, control sections during which a horizontal unbalancing phenomenon and a vertical unbalancing phenomenon occur are preset so that although the liquid fails to reach the proper position in the balancer ring 121, the bias can be sufficiently compensated, thus lessening noises caused by the unbalancing phenomena.

Although the embodiments of the method of controlling the washing machine 100 has been described with reference to the accompanying drawings, the present invention is not limited thereto.

In the method of controlling the washing machine 100 according to the embodiment of the present invention, abnormal vibration phenomena, such as, for example, horizontal and vertical unbalancing phenomena of the inner tub 115, may be avoided by controlling the rotation of the inner tub 115 based on preset control values of the inner tub 115 without a separate vibration sensing means of sensing the abnormal vibration phenomena. However, in the case of providing a separate vibration sensing means, the present invention may be implemented so that the method of controlling the washing machine 100 described above may be performed when the vibration sensing means sense the abnormal vibration phenomenon.

The invention has been explained above with reference to exemplary embodiments. It will be evident to those skilled in the art that various modifications may be made thereto without departing from the broader spirit and scope of the invention. Further, although the invention has been described in the context its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is:

1. A method of controlling a washing machine having an auto balancer that compensates for an unbalancing phenomenon occurring when an inner tub rotates, wherein the inner tub is rotably disposed vertically inside an outer tub at a top side of which an opening for entering and exiting laundry is formed, the method comprising:

a step of setting a first lower RPM value and a first higher RPM value, wherein the inner tub is biased in a left and right direction of the inner tub and causes a first unbalancing rotation if the inner tub rotates constantly at a first RPM between the first lower RPM value and the first higher RPM value; and a step of controlling the inner tub to be rotated constantly at at least one predetermined RPM lower than the first lower RPM value for a predetermined time period, and then be accelerated from the predetermined RPM lower than the first lower RPM value to a second RPM higher than the first higher RPM value such that the inner tub is not rotated constantly at the first RPM, and then controlling the inner tub to be rotated constantly at the second RPM for a predetermined time period.

2. The method of claim 1, further comprising:

a step of setting a third lower RPM value which is higher than the second RPM and a third higher RPM value, wherein the inner tub is biased in an upper and lower direction of the inner tub and causes a second unbalancing rotation if the inner tub rotates constantly at a third RPM between the third lower RPM value and the third higher RPM value; and a step of controlling the inner tub to be incrementally accelerated from the second RPM to a fourth RPM which is higher than the third higher RPM value such that the inner tub rotates consecutively at a plurality of constant rotation speeds which are increased step-by-step.

3. The method of claim 1, wherein the controlling step comprises accelerating the rotation of the inner tub to the second RPM when a rotation speed of the inner tub reaches the first lower RPM value.

4. The method of claim 2, wherein the constant rotation speeds comprises at least five constant rotation speeds having a same speed interval therebetween.

5. The method of claim 2, wherein incrementally accelerating the rotation of the inner tub is performed when a rotation speed of the inner tub reaches the third lower RPM value.

6. The method of claim 1, wherein the first lower RPM value is higher than 40 and the first higher RPM value is lower than 120.

7. The method of claim 2, wherein the third lower RPM value is higher than 120 and the third higher RPM value is lower than 240.

* * * * *